US005156734A

United States Patent [19]

Bowles

[11] Patent Number: 5,156,734

[45] Date of Patent: Oct. 20, 1992

[54] ENHANCED EFFICIENCY HYDROCARBON EDUCTION PROCESS AND APPARATUS

[76] Inventor: Vernon O. Bowles, 1720 Hurricane Harbor La., Naples, Fla. 33940

[21] Appl. No.: 599,656

[22] Filed: Oct. 18, 1990

[51] Int. Cl.[5] ..... C10G 1/00

[52] U.S. Cl. ..... 208/409; 208/410; 208/411; 208/407; 208/427; 208/432; 208/426

[58] Field of Search ..... 208/404, 407, 409, 410, 208/411, 426, 432, 424

[56] References Cited

U.S. PATENT DOCUMENTS

| | | | |
|---|---|---|---|
| 3,184,462 | 1/1964 | Frick | 208/427 |
| 3,619,405 | 11/1965 | Smith | 208/427 |
| 3,623,972 | 10/1968 | Bennett | 208/427 |
| 3,925,109 | 12/1975 | Whitcombe et al. | 208/427 |
| 3,976,558 | 8/1976 | Hall | 208/11 R |
| 4,005,752 | 2/1977 | Cha | 166/260 |
| 4,010,092 | 3/1977 | Deering | 208/11 R |
| 4,025,416 | 5/1977 | Deering et al. | 208/11 R |
| 4,043,897 | 8/1977 | Deering | 208/11 R |
| 4,087,347 | 5/1978 | Langlois et al. | 208/11 R |
| 4,092,237 | 5/1978 | Reed | 208/11 R |
| 4,110,193 | 8/1978 | Gwyn et al. | 208/11 R |
| 4,125,453 | 11/1978 | Tamm et al. | 208/11 R |
| 4,127,469 | 11/1978 | Young | 208/11 R |
| 4,210,492 | 7/1980 | Roberts | 201/12 |
| 4,222,850 | 9/1980 | Matthews | 208/11 R |
| 4,227,990 | 10/1980 | Dearth et al. | 208/432 |
| 4,293,390 | 10/1981 | Chalmers et al. | 202/100 |
| 4,326,471 | 4/1982 | Rohrbach et al. | 110/341 |
| 4,340,463 | 7/1982 | Harak | 208/11 R |
| 4,384,947 | 5/1983 | Van Zanten | 208/11 R |
| 4,412,909 | 11/1983 | Faulkner et al. | 208/11 R |
| 4,412,910 | 11/1983 | Archer et al. | 208/11 R |
| 4,435,271 | 3/1984 | Deering et al. | 208/11 R |
| 4,441,985 | 4/1984 | Burchfield et al. | 208/11 R |
| 4,446,001 | 5/1984 | Deering et al. | 208/11 R |
| 4,447,090 | 5/1984 | Knepper | 299/2 |
| 4,448,668 | 5/1984 | Deering | 208/11 R |
| 4,454,019 | 6/1984 | Venkatesan | 208/424 |
| 4,454,915 | 6/1984 | York et al. | 166/259 |
| 4,464,247 | 8/1984 | Thacker | 208/11 R |
| 4,515,679 | 5/1985 | Deering | 208/11 R |
| 4,530,752 | 7/1985 | Deering et al. | 208/11 R |
| 4,532,991 | 8/1985 | Hoekstra et al. | 166/261 |
| 4,534,849 | 8/1985 | Edwards | 208/400 |
| 4,548,702 | 10/1985 | York et al. | 208/11 R |
| 4,551,206 | 11/1985 | Deering et al. | 202/99 |
| 4,552,214 | 11/1985 | Forgac et al. | 166/259 |
| 4,564,437 | 1/1986 | Deering | 208/11 R |
| 4,606,138 | 8/1986 | Gentry | 34/182 |
| 4,637,464 | 1/1987 | Forgac et al. | 166/261 |

FOREIGN PATENT DOCUMENTS

| | | | |
|---|---|---|---|
| 3614649 | 11/1986 | Fed. Rep. of Germany | 208/404 |

*Primary Examiner*—Helane Myers
*Attorney, Agent, or Firm*—Weingarten, Schurgin, Gagnebin & Hayes

[57] ABSTRACT

A system and process for educing hydrocarbons from shale. The system comprises a retort vessel which has an integral apparatus for mixing raw and recycle shale that embodies raw shale pulverizing and has an integral apparatus for finally pulverizing the raw shale particulates that have descended through a fluidized bed. The system further comprises: a burner which generates process heat; heat transfer apparatus which extracts heat for use in the process; and means for recovering such heat. The process involves recovery of significant amounts of process energy including: the recovery of heat from retort vapors; the recovery of heat from spent shale; recovery and utilization of the heat of combustion; and recycling of gases for the operation of mechanical pulverizing apparatus. Significant amounts of process energy are recovered to drive recycle gas compressors, air compressors, and other energy consumers, and to motivate pulverizers resident in the retort vessel for enhancing the flow and recyclability of in-process shale, all is all resulting in a highly thermally efficient and commercially viable oil shale retorting process.

8 Claims, 3 Drawing Sheets

ENHANCED EFFICIENCY HYDROCARBON EDUCTION PROCESS AND APPARATUS

FIELD OF THE INVENTION

The present invention relates to the retorting of solids containing hydrocarbons, particularly to retorting oil shale.

BACKGROUND OF THE INVENTION

Increasing demand and dependence on the world's crude oil resources portends a grim reality which is exacerbated by the declining availability of those resources. Oil is, and will become even more so, a precious resource the availability of which will be an important determinative of the standard of living in years to come. Crude oil resources are non-renewable. Therefore, an energy intensive world economy will require maximum recovery of oil from the repositories in which it is contained.

Various processes are known for educing oil from hydrocarbon containing solids, such as shale and tar sands using fluidized bed retorting apparatus. Such retorting typically involves hot gaseous products passing upwardly to fluidize a bed of hydrocarbon containing medium, such as tar sands, oil shale and the like. The upwardly flowing gaseous products serve as a sweeping medium for the shale hydrocarbon products which exit the top of a retort. U.S. Pat. No. 4,412,910 to Archer, et al exemplifies such a retorting process. Raw shale is applied to an apparatus wherein gas traveling upward through a fluidized bed of hot raw and spent shale pyrolyzes the raw shale causing its oil and volatile hydrocarbons to rise to the top of the fluidized bed where it is transferred to a gasifier. Oxygen and steam are supplied to the gasifier and react with the carbon of the pyrolyzed shale to produce the desired hydrocarbon by-product. In Archer, et al., the hot gas fluidizes the raw shale in the pyrolyzer apparatus. The hot gas and hot spent shale heat the raw shale while the hot gas acts as a sweeping and transfer medium for the product gas and shale oil components which are subsequently condensed and collected. None of the heat from the product vapors is recovered to provide for process energy requirements in the Archer process.

U.S. Pat. No. 4,087,347 to Langlois, et al shows a shale retorting process in which the solids to be retorted are mixed with a solid heat transfer material to rapidly heat the hydrocarbon containing solids to a high temperature. Langlois discloses that spent retorted shale may be used as the solid heat transfer material. The shale and heat transfer material in Langlois are entrained in a gaseous stream and conveyed upwardly in a gas lift pipe to a retorting vessel in which the hydrocarbon containing solids are rapidly heated so as to vaporize a portion of the hydrocarbons in the solid. The gas and solids in the stream are separated in a disengaging zone in which the partially retorted solids settle to a gravitating bed retort to flow downward countercurrent to the flow of recycle product stripping gas. The upward flow of stripping gas and the gaseous stream from the gas lift are then processed in cyclone separators to separate the product gas from any entrained solids. While Langlois mentions spent shale and product gas recycling, no attempt is made to recover the vast amount of heat in the discarded spent shale or of the heat in the hot flue gases, greatly detracting from the thermal efficiency of the process. Furthermore, a Process such as Langlois discloses does not attempt to collect and use the considerable heat present in the retort product stream.

A method and apparatus for pyrolyzing crushed oil shale of one quarter inch or less is taught in U.S. Pat. No. 3,976,558 to Hall. Hall uses catalytic cracking technology involving fluidizable solids as a heat carrier for achieving pyrolysis of one quarter inch or smaller precrushed raw shale. Pyrolysis vapors exiting from the top of a pyrolyzer of similar design to a conventional catalytic cracker reactor, pass through a vapor cyclone for removing smaller particles or fines and is passed to a fractionator condenser where the vapors are partially condensed and separated into oil and gas. A stream of gas taken from the fractionator is recycled without heat addition, to control fluidization of the countercurrent fluidized bed reactor. Hall makes no attempt to recover the vast amount of heat remaining after the air preheating step. The thermal efficiency embodied in the Hall disclosure leaves much to be desired.

Renewed interest in extracting oil and gas from hydrocarbon containing solids requires that any process for doing so be commercially viable in light of the vast amounts of hydrocarbon containing solids which must be processed in order to yield a relatively small amount of oil and gas product. Although increasing demand for oil and gas may enhance the commercial viability of prior art processes by increasing the value of the oil and gas product, many processes for educing oil and gas from hydrocarbon containing solids according to the prior art are limited in throughput capacity, require a multiplicity of processing units, and further, oil shale retorting and eduction processes and apparatus known in the art are thermally inefficient, requiring that costly amounts of energy be introduced into the process of recovering oil and gas from raw shale, thus diminishing the commercial viability of such processes.

SUMMARY OF THE INVENTION

The present invention provides a thermally efficient system and process for educing hydrocarbons from shale. The system comprises a retort vessel having in its upper section an integral apparatus for mixing raw and hot recycle shale and educing vaporous shale oil components therefrom. The retort also embodies an integral apparatus for pulverizing shale Particles that descend through the mixing apparatus and also an apparatus for pulverizing shale particles that have descended through the fluidized bed. The system further comprises a burner for generating process heat, heat transfer apparatus for extracting heat for use in the process, and means for recycling such heat. The process incorporates the recycling and recovery of significant amounts of process energy including: the recycling and use of energy from retort vapors; recycling and use of heat from spent shale; efficient use of the heat of combustion; recycling of gases for fluidizing the retort bed and for the operation of mechanical pulverizing apparatus and recycling of gases for transfer of heat from spent shale to raw shale feed. Steam generated from retort vapor successive condensation and spent shale heat exchange is used to drive compressor turbines supplying the energy requirements for air compressors and gas circulators employed in the system and other energy requirements, all resulting in a highly thermally efficient oil shale retorting process.

Features of the invention include enhanced uniformity of exposure of oil shale, to heating medium resulting in high retorted shale oil recovery. The invention embodies separation and utilization of retort gases and combustion gases, and results in minimized carbonate decomposition in the retort while requiring minimized dependence on undeveloped technology.

DESCRIPTION OF THE DRAWING

These and other features and advantages of the present invention will become more apparent in light of the following detailed description of an illustrative embodiment thereof, as illustrated in the accompanying drawings, of which.

DETAILED DESCRIPTION OF THE INVENTION

Figure 1A:
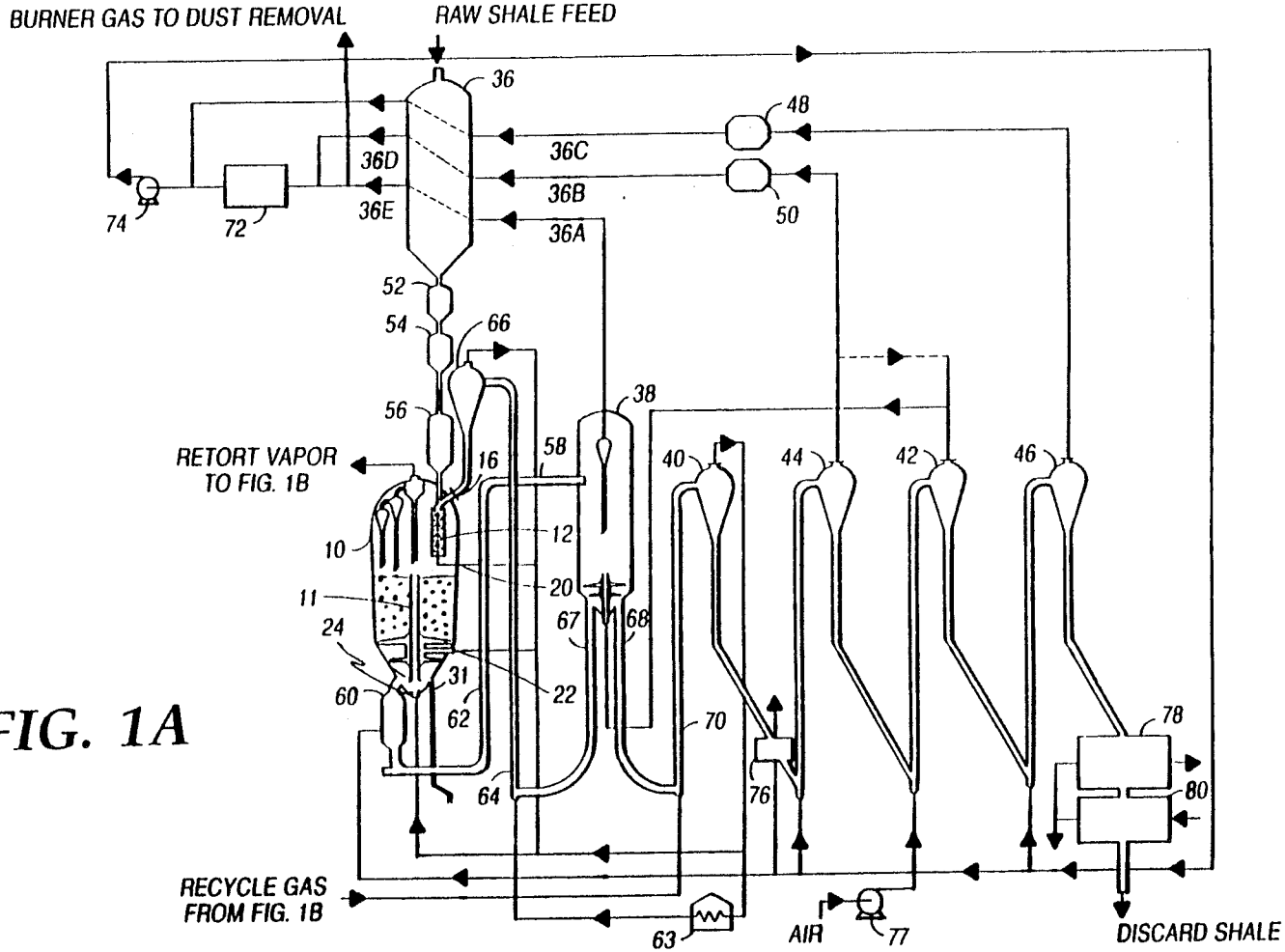
FIG. 1A is a diagrammatic representation of a retort vessel and associated heat exchange components according to the invention.
Figure 1B:
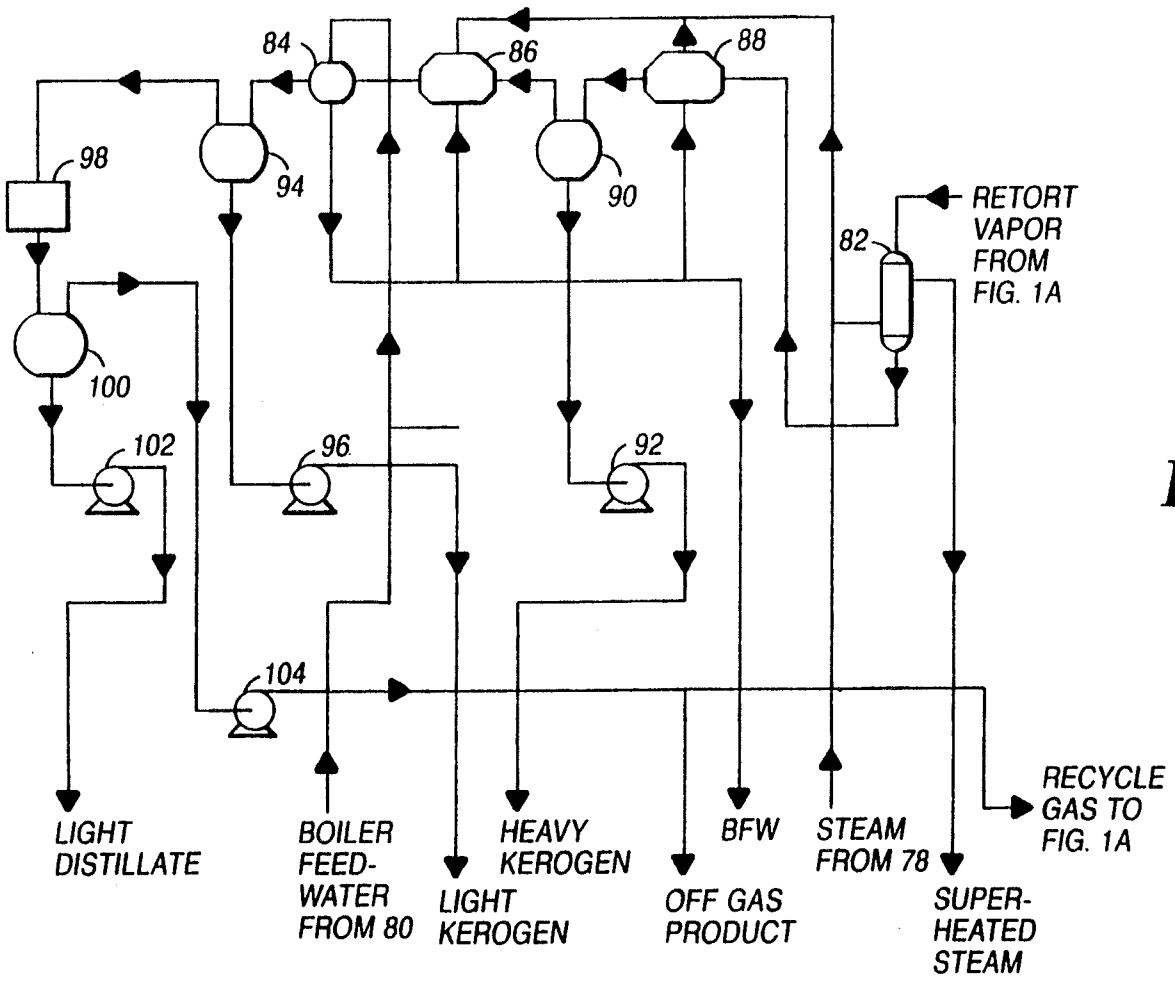
FIG. 1B is a diagrammatic representation of a retort vapor heat recovery system employing successive condensation which operates in conjunction with the retorting and heat exchange apparatus of FIG. 1A, in the shale retorting system according to the invention.

Referring now to FIGS. 1A and 1B, a retort vessel 10 is central to the retorting process according to the invention. Various interconnected components facilitate the processing of shale to usable hydrocarbon products. A raw shale preheater 36 preprocesses the shale and passes preheated raw shale to a series of interlocks 52, 54 for collection in a surge chamber 56 prior to introduction into an internal retort raw shale/recycle shale mixer 12. Retorted shale exits the retort 10 into a stripper 60 which displaces with stripping medium vaporous shale oil components back into retort 10 and prevents them from flowing into the burner/combustor 38. The retorted shale exiting stripper 60 is lifted with recycle flue gas via a retorted shale lift 62, to a burner/combustor 38. Flue gases from the combustor 38 flow to the shale preheater 36 to bring about the preheating of the raw shale feed. A first recycle shale lift 64 uses heated recycle product gas to move combusted hot recycle shale to the retort resident mixer 12, via a separator 66 which separates heated recycle product gas from the lifted recycle shale, for fluidizing the shale bed in the retort 10 and to provide shale particle fluidizing and shale oil component eduction means therein as described below. A second spent shale lift 70 receives discard shale from the combustor 38 and lifts it to a first separator 40 in a series of separators 40, 44, 42, 46 used for heat transfer as described below and for discard shale cooling.

The discard shale transferred in the shale lift 70 with product recycle gas is carried to a cyclone separator 40 which separates shale from the heated product recycle gas that is to be employed in the system as discussed hereinafter. Discard shale, cooled somewhat in the separator 40 is further lifted with recycle flue gas to a first stage 44 of a two-stage flue gas heater/discard shale cooler, of which a separator 46 acts as a second stage. Both stages 44, 46 of the flue gas heater/spent shale cooler separate hot recycle flue gas from the lifted discard shale and supply the hot recycle flue gas to burners 48, 50 for further heating if necessary, and for ultimately providing the heated flue gas to the raw shale preheater 38. Before the discard shale from the first stage 44 of the flue gas heater is lifted to the second stage separator 46, a heat transfer is effected in an air lift heater/separator 42 which heats combustion air flowing to the burner 38. Air is introduced into the heat transfer section of the retorting process by air compressor 77 and circulation of flue gas leaving preheater 36 is facilitated by recycle flue gas circulation compressor 74 after being cooled in air cooler 72.

Retort vapors, comprising kerogens, elemental hydrocarbons, and miscellaneous other gases disengaged from the retort 10 are passed to a retort vapor heat recovery system which implements successive condensation in the process as illustrated in FIG. 1B, wherein the hydrocarbon products are condensed and the recycle gas and product gas is recovered. The condensation section comprises a steam superheater 82 receiving saturated 400 psig steam from two steam generator/heat exchangers 88, 86, each in combination with a respective kerogen product phase separator 90, 94, as well as from discard shale steam generator 78. The heat exchanger and phase separator sets 88/90, 86/84/94 and an air cooler 98 in conjunction with a final phase separator 100, recover approximately 80% of available heat in the form of superheated 400 psig steam from the 1000° F. retort vapors to produce three liquid products and a retort product gas. Additionally, a post-condensation recycle product gas from separator 100 is delivered by a compressor 104 back to the retorting and heat transfer section described hereinbefore.

Figure 2:
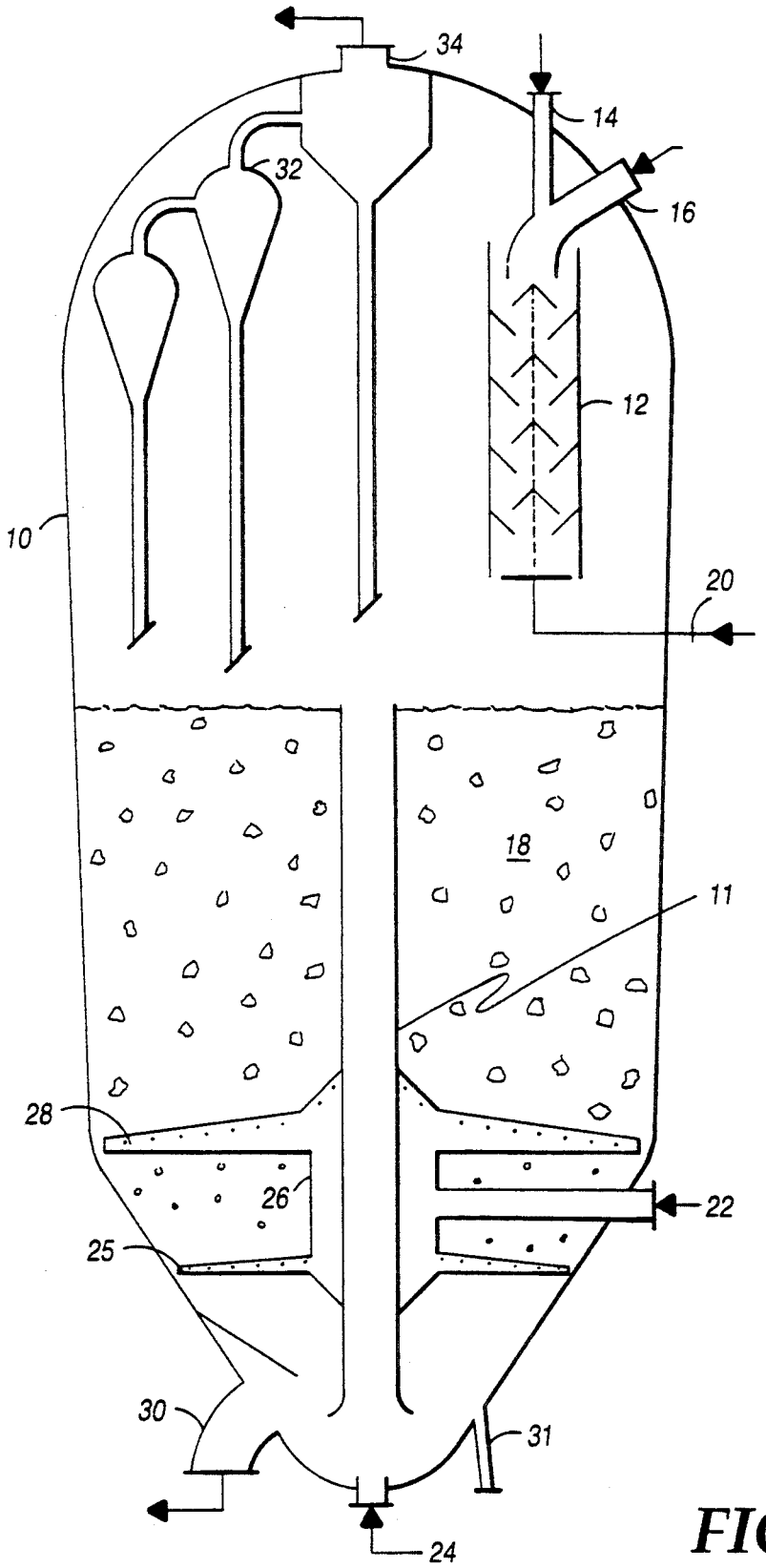
FIG. 2 is a sectioned representation of a retort vessel embodying recycle gas shale pulverization and eduction of shale oil and gas components according to the invention.

Referring now to FIG. 2, a retort vessel 10 is substantially cylindrical but slightly conical to accommodate shale Processing vapor expansion with proper fluidization velocity relationships. The vessel 10 has a bottom diameter of 39 feet and a top diameter of 45 feet providing approximate superficial velocities of 2.1 feet per second and 2.8 feet per second, respectively. The vessel 10 accommodates a shale bed depth of approximately 30 feet. Solids flow is approximately 115 tons per minute (net spent shale plus recycle shale) so that residence time of in-process shale is in the range of 3–4 minutes. The retort, according to the invention accommodates three raw shale-recycle shale mixer/heater units 12, although only one is shown in FIG. 2, each comprising a raw shale feed 14 capable of receiving 15 tons per minute and a hot recycle shale feed 16 capable of receiving approximately 25 tons per minute. The mixer 12 is a series of cylindrically contained baffles which facilitate the intimate mixing of preheated raw shale introduced at the raw shale feed 14 with hot recycle shale introduced at the spent shale feed 16, in order to facilitate direct contact heating of the recycle and raw shale introduced to the retort 10. The mixing function performed by the mixer 12 can be implemented by incorporation of a rotating mechanical abrader or gas jet pulverizers which would perform or augment heater/-mixer abrasion of raw shale particles as a first stage of retort-resident mechanical and/or jet pulverization of the raw shale feed. In either case, direct intimate contact feeding of preheated raw shale into the mixer with hot recycle shale results in rapid elevation of the temperature of the raw shale feed, which will cause a substantial increase in the friability of the raw shale. Accordingly, the direct contact of the highly friable raw shale, in the mixer, with the hot recycle shale results in a substantial decrease in the particle size of shale gravitating toward the shale bed 18 directly beneath the mixer 12. Mechanical and/or gas jet pulverization, provided in the retort 10 and driven by recycle product gas, generated in the process discussed hereinafter, is introduced to the vessel at a first recycle product gas feed 20. Recycle product gas drives mechanical graters or gas jet pulverizers disposed in mixer 12, directly above the shale bed 18 and aids in the eduction of shale oil components from the raw shale particles. It is desirable, in the retorting process according to the invention, to reduce shale particle size through retort resident pulverization so as to expose as much shale surface area as possible in the fluidized bed of the retort.

While the shale bed 18 gravitates downwardly in the vessel 10, recycle gas is also introduced into the vessel at the second recycle product gas feed 22 and flows upwardly, fluidizing the countercurrent solids bed. The upwardly flowing recycle product gas serves as a sweeping and transport medium for educed shale oil components. Thus, the recycle product gas generated and processed according to the invention as discussed hereinafter, provides multiple functions in the retort, including: abrading the particulate raw shale feed into fluidizable material; fluidizing the retort bed; stripping and carrying released shale oil components; and completing pulverization of any less friable oil shale particles settling through the fluidized bed.

Particulate pulverization is facilitated near the bottom of the retort vessel 10 by a second level 25 of a two-level gas distribution and jet pulverization deck 26. A first level 28 of the two-level gas distribution deck facilitates dispersion of the recycle gas fluidization and sweeping medium. In the second level 25 recycle product gas jets act to abrade raw shale particles not yet reduced to fluidizable size and also direct said particles toward the lower central region of the retort 10 surrounding an internal lift 11 along with action from baffles 13, where they are lifted by recycle product gas entering port 24 to the region above retort bed 18 and are thus recycled as noted below. Fine particulate retorted and recycled shale exits the vessel 10 at a bottom exit port 30 and stripper 60 for combustion processing in burner 38 and subsequent recycling to retort 10 and for heat transfer processing as detailed hereinafter. It is envisioned that there may be three or more retorted shale bottom exits 30 and strippers 60 to facilitate downstream equipment design economies.

Ultimately, insufficiently abraded shale particulates that accumulate in the bottom of retort 10, are jetted upwardly through internal lift pipe 11 at a third recycle product gas feed entering retort bottom gas entrance 24 and exit the top of lift pipe 11 to fall back into the fluidized shale bed 18 for further abrasion action in the bottom of retort 10 as hereinbefore described. A comparatively small amount of accumulated large particle retorted shale exits the retort vessel 10 at a second exit port 31 and may be discarded or recycled, but preferably is expunged from the recycle stream so as to preserve fluidity of solids flowing through the shale recycle paths.

Retort vapors traveling upward through the vessel are captured and processed in the vessel by a three-stage cyclone separator 32 which processes retort vapors in a first and second stage, dropping shale fines and powders back to the bed below and sending retorted shale oil, vapors recycle gas and gas product to a final stage of cyclone separation 34 for disengagement from the retort vessel 10. It is envisioned that vapor flow consideration and design economies may dictate the use of three or more pairs of first and second stage cyclones.

The processing of raw shale, according to the invention, commences with crushed raw shale of approximately ½ inch and smaller particle size being introduced into the process at a preheater 36 (FIG. 1A). The raw shale preheater 36 is a moving bed vessel which provides three countercurrent contacts of raw shale plant feed with heated burner and recycle flue gas. Three-stage preheating is facilitated by the burner and recycle flue gas feeds 36A, 36B, and 36C which deliver burner combustion gas, first stage recycle flue gas and second stage recycle flue gas, respectively, to the preheater 36. The raw shale plant feed gravitating downward in the preheater 36 is preheated to increase the raw shale temperature from its initial preprocess temperature of approximately 50° F. up to approximately 200° F., by direct contact with recycle flue gas from the second stage flue gas heater 46 which may be further heated from approximately 650° F. to about 1150° F. if necessary, by a first in-line burner 48. A second contact heating is effected at the preheater gas feed 36B to increase the temperature of the descending raw shale to approximately 360° F. by contacting the raw shale with recycle flue gas exiting the first stage flue gas heater 44 at approximately 865° F. and which is delivered to the preheater 36 at a temperature of 1300° F. after being further heated by a second in-line burner 50 if necessary. A third and final raw shale preheating stage, which further preheats the raw shale to approximately 500° F., is effected at the preheater gas feed 36A which supplies 1300° F. combustion gas directly from the burner 38. It is not desirable to preheat the descending raw shale beyond approximately 500° F. as this might result in premature retorting.

It should be noted that the small fuel requirements of the in-line burners 48, 50 can be fueled by downstream retort product gas which has had all heavier components removed therefrom in a gas plant process unit downstream from the retorting process or by any other available fuel mediums. However, at system start-up the in-line burners are instrumental for accomplishing initial preheating and may be fueled by any non-process energy known in the art.

According to the invention, preheat gas having been supplied to the preheater 36 by the second stage flue gas heater 46, the first stage flue gas heater 44, and the burner 38, exits the preheater 36 at the preheater exit ports 36D, 36E, and 36F. The preheated gas exiting ports 36D and 36E flows to a gas air cooler 72 and then to compressor 74. The preheat gas exiting port 36F is sufficiently cool that it can bypass air cooler 72 and flow along with the gas from cooler 72 to compressor 74 which provides the hydraulic energy required to drive combustion gas through the first and second stage flue gas heaters 44, 46 and through the two stages of raw shale preheating at gas feed ports 36B and 36C. The preheated (approximately 500° F.) raw shale exits the preheating vessel 36 and descends through lock chambers 52, 54, and finally collects in a surge chamber 56 prior to introduction to the integral mixer 12 of the retort vessel 10 for mixing and retorting as discussed hereinbefore.

Retorting, according to the invention, utilizes a significant amount of in-process energy to maintain the process. On the basis of 50,000 barrels per day shale oil production, the burner/combustor 38 moreover provides for nearly all of the heat requirements of the overall process by combusting approximately 70,000 to 80,000 lbs per hour of carbon deposit residing in the retorted oil shale. The burner/combustor 38 receives approximately 115 tons per minute of raw and recycle shale at the burner feed 58. The burner is fed from stripper 60 located at the bottom of the retort vessel 10, the output of which is transferred by recycle flue gas from compressor 74 via lift 62 upwardly to burner feed 58. The retort stripper discharge feeds the burner with 115 tons per minute of material comprising approximately 40 tons per minute of retorted oil shale containing about 0.8 tons per minute of coke, plus 75 tons per minute of recycle shale (having previously been combusted and mixed with raw shale in the retort at the mixer 12) containing only about 0.4 tons per minute of coke. As noted before, approximately 70,000 to 80,000 lbs per hour of coke is converted by combustion to heat the large mass of shale passing through the burner and to generate the burner/combustor gas used in the final stage of preheating of raw shale as discussed hereinbefore.

Further, of the total amount of shale passing through burner 38, approximately 75 tons per minute of recycle shale exits burner 38 at the burner bottom exit port 67. This recycle shale is maintained at approximately 1300° F. while being transferred to the retort 10 by recycle product gas exiting the recycle gas heater cyclone 40 at approximately 1000° F. after which it is further heated to 1300° F. in auxiliary heater 63. The recycle shale is lifted via the recycle shale lift 64 to the separator 66 connected to recycle shale feed 16 which provides the hot recycle shale for mixing with raw shale in the mixer 12 in the upper region of retort 10. The 1300° F. recycle gas separated from the recycle shale at the separator 66 is retained in the system and is introduced into retort vessel 10 at the recycle gas feeds 20, 22 and 24.

A second burner exit port 68 at the bottom of the burner 38 concurrently delivers combusted shale discard to the first discard shale lift 70 where the 1300° F. discard shale is lifted using unheated recycle gas from the retort vapor heat recovery system of FIG. 1B. The recycle gas from the retort vapor heat recovery system lifts the discard shale to the recycle gas heater cyclone separator 40 which also serves as a discard shale cooler transferring heat from the 1300° F. discard shale in the form of 1000° F. discard shale and 1000° F. recycle gas. The 1000° F. recycle gas is further heated in the heater 63 to 1300° F. and is introduced to the shale lift 64, to lift 75 tones per minute of recycle shale to the cyclone separator 66 for feeding the mixer 12 in the retort 10, as discussed hereinbefore. The recycle gas exiting separator 66 at a temperature of approximately 1300° F. provides fluidization and stripping medium to the retort vessel 10 at the retort gas inlet port 22. This recycle gas is also delivered to retort inlet port 20 to provide mechanical and/or gas jet abrasion and shale oil component eduction in mixer 12 as hereinbefore noted. Furthermore, this recycle gas stream is also delivered to retort bottom inlet port 24 to bring about large shale particle recycling and abrasion within retort 10 via internal lift conduit 11 as hereinbefore noted. The 1000° F. discard shale exiting recycle gas heater 40 descends through a purge vessel 76 to remove entrained recycle gas which can be incinerated or recovered if economical.

The 1000° F. discard shale exits the purge vessel 76 to the first stage recycle flue gas heater/discard shale cooler 44 lift which carries the discard shale to the first stage flue gas heater cyclone 44 where, as discussed hereinbefore, flue gas is separated and transferred at approximately 865° F. for further heating to 1300° F. if necessary, by the in-line burner 50, to provide the second stage of preheating the raw shale in the raw shale preheater 36 at port 36B. From the first stage flue gas heater cyclone 44 the fluidized discard shale is driven via another shale lift and the air from compressor 77, to the air heater cyclone 42 wherein the air is preheated for introduction to the burner 38 to fluidize the bed therein and provides the means for combustion of the coke associated with the retorted shale.

Discard shale from the air heater cyclone 42 is lifted by second stage recycle flue gas, via the discard shale lift to a second stage flue gas heater cyclone 46, which as described hereinbefore, provides initial preheating for raw shale descending in the preheater 36 at port 36C. The quantities of flue gas flowing from the first and second flue gas heater cyclones 44, 46 is set to satisfy the discard shale cooling and recycle flue gas heating needs for transferring heat to raw shale preheater 36. The burner off-gas passing to dust removal facilities is equal to the quantity of combustion gas flowing from the burner 38 plus whatever additional flue gas is generated in in-line heaters 48 and 50.

The discard shale from the second stage flue gas heater cyclone 46 exits the second stage flue gas heater and is processed through a steam generator 78, as known in the art, thus further reducing the temperature of the discard shale from 650° F., at which it leaves the second stage flue gas heater, to approximately 475° F. Considerable quantities of useful thermal energy are extracted in the form of approximately 243,000 lbs per hour of saturated 400 psig steam. This quantity of steam is delivered to steam superheater 82, shown on FIG. 1B, along with quantities of saturated steam delivered from steam generators 86 and 88, also shown on FIG. 1B. The total quantity of superheated steam exiting superheater 82 (approximately 627,000 lbs/hr) will supply most of the energy requirements for driving the recycle process gas circulating compressor 104, the recycle flue gas circulating 13 compressor 74, and the air compressor 77. The 475° F. discard shale, after processing by the steam generator 78, is further used to heat boiler feedwater in heat exchanger 80, reducing the temperature of the discard shale to approximately 300° F., while extracting valuable energy therefrom. The preheated boiler feedwater is available for use in steam generators 86 and 88, and surplus preheated boiler feedwater may be delivered to a central steam generating plant associated with the oil shale retorting facility.

The shale oil successive condensation and retort vapor heat recovery process, referring now to FIG. 1B, is used to process the shale oil vapors exiting the retort vessel 10 at an elevated temperature of 1000° F. The successive condensation effects the production of heavy kerogen, light kerogen, light distillate and an off-gas product from the retort vapors exiting the retort vessel 10 at the disengaging cyclone 34 (FIG. 2) while recovering approximately 80% of the hot retort vapor heat content in the form of 660° F. superheated 400 psig steam and 400° F. preheated 400 psig boiler feedwater.

As can be seen in FIG. 1B, the 1000° F. vapors from the retort vessel 10 are received in the condensation process at the superheater 82, which is a vapor phase heat exchanger that superheats steam from the steam generators 78, 86 and 88 to a temperature of 660° F. while reducing the retort vapor temperature from 1000°

F. to 900° F. (FIGS. 1A and 1B). The 900° F. retort vapors next flow to steam generator 88 where the retort vapor temperature is reduced to 600° F. while generating 400 psig saturated steam from 400° F. boiler feedwater preheated in exchanger 84. The retort vapor liquid mixture exiting steam generator 88 next flows to phase separator 90 where heavy kerogen liquid is separated and is removed by pump 92 and delivered to hydrotreating facilities as known in the art. The retort vapors leaving phase separator 90 flow to steam generator 86 where the retort vapor temperature is further reduced to 475° F. while generating 400 psig saturated steam from preheated boiler feedwater delivered from exchanger 84 as noted above. After generating steam in generator 86, the retort vapors flow to boiler feedwater exchanger 84 where the retort vapor temperature is reduced to 300° F. and 400 psig boiler feedwater temperature is raised from 230° F. to 400° F. for use in steam generators 86, 88 and elsewhere in the oil shale complex. The retort vapor/liquid mixture exiting boiler feedwater heater 84 next flows to phase separator 94 where light kerogen liquid is separated and flows to pump 96 for delivery to hydrotreating facilities known in the art. The light retort vapors exiting phase separator 94 next flow to air-cooler 98 and then to phase separator 100 where light distillate is separated and flows to pump 102 which delivers the liquid along with off-gas product from compressor 104 to downstream gas plant facilities known to the art. Vapor from the final phase separator 100 is gas which is comprised of net off-gas product and process recycle gas which flows to compressor 104 for delivery and use as noted hereinbefore. The off-gas product delivered from compressor 104 after gas plant processing may be used to fuel in-line burners 48 and 50 and for extensive other uses in the oil shale processing complex. Recycle gas from the compressor 104 is fed back to the discard shale lift 70 and recycle gas heater 40 (FIG. 1A), as discussed hereinbefore.

The cost effectiveness of hydrocarbon containing solid retorting processes is directly dependent upon the scale of such a process and the ability to Process very large amounts of hydrocarbon containing solids or shale. Thus, although the retorting process according to this invention is described hereinafter as comprising one shale retort vessel and one or more burners or combustion vessels and associated heat exchange apparatus, such a process may be configured as a complex, comprising several retort vessels, and several burners and associated heat exchange apparatus. The magnitude of such a process is necessitated by economies of scale and the realities of having to process and recycle enormous amounts of raw oil shale and spent shale. Such a complex according to the invention might be capable of a production capacity of 50,000 barrels of shale oil per day, to be recovered by processing 64,000 to 65,000 tons per day of raw oil shale. Processing capabilities of 45 tons per minute of raw oil shale might well be desirable in order to achieve the economies of scale that would justify the capital expenditures for such a complex. The retort vessel central to such a complex must be capable of accommodating a fluidized bed of a magnitude necessary to process the quantities of raw and recycled shale indicated hereinbefore although, the dimensions and design are not beyond the scope and bounds of present day catalytic cracking technology.

Although a single retort vessel of specified diameter is described herein, it can be appreciated that a larger or smaller retort vessel or a plurality of vessels may be desirable depending on the desired unit capacity and the economics of capital cost and operating expense.

Although only one set of each of the retort associated components is shown and described, it should be understood that the retort in a complex requires an associated set of components. For example, in a process of the magnitude discussed hereinbefore, three burners and a train of associated downstream facilities (each associated with a central retort vessel) might be required although only one is shown and discussed herein.

Although the preheating of raw shale herein is described as "countercurrent" it can be appreciated that such preheating may also be done concurrent to raw shale flow or by other means known in the art.

While cyclone separators, heat exchangers and steam generators are described generally herein, one of ordinary skill in the art can appreciate that the process functions carried out in this high thermal efficiency retorting process with very high heat recovery efficiency, may be carried out with a variety of heat exchange apparatus and transfer devices known in the art.

Although the invention has been shown and described with respect to an exemplary embodiment thereof, it should be understood by those skilled in the art, that the foregoing and various other changes, omissions and additions in the form and detail thereof may be made therein without departing from the spirit and scope of the invention.

What is claimed is:

1. A process for educing hydrocarbons from hydrocarbon containing solids, said process comprising the steps of:

preheating raw hydrocarbon containing solids, in a preheater, with a first stage, a second stage and a third stage of gas contact heating;

conveying the preheated raw hydrocarbon containing solids to a retort vessel having a top and a bottom, wherein the hydrocarbon containing solids are subjected to a method of retorting including the steps of:

mixing the raw hydrocarbon containing solids with a stream of high temperature recycled solids using a mixing apparatus proximate to said top in said retort vessel, said recycle solids being transferred to said retort vessel from a combustion vessel via a first lift driven by a first recycle gas;

pulverizing the raw hydrocarbon containing solids with a pulverizer driven by said first recycle gas;

gravitating the hydrocarbon containing solids downwardly toward at least two exit ports proximate to said bottom of said retort vessel;

fluidizing and sweeping the hydrocarbon containing solids in said retort vessel with said first recycle gas introduced into said retort vessel at a gas feed proximate to the bottom of said vessel, said first recycle gas being disbursed throughout the hydrocarbon containing solids by at least one level of a gas jet deck and travelling upwardly countercurrent to said solids and transporting entrained hydrocarbon components;

disengaging the hydrocarbon components from said retort vessel as retort vapors;

using a second recycle gas to drive retorted hydrocarbon containing solids, exiting said retort vessel at one of said at least two exit ports proximate to bottom of said retort, through a second lift to said combustion vessel for combusting to discard solids;

conveying discard solids, via a third lift, using said first recycle gas, from said combustion vessel to a first separator and heat transfer apparatus;

separating discard solids in said first separator and heat transfer apparatus from said first recycle gas and transferring said first recycle gas to said first lift, and to said gas feeds of said retort vessel, and to said pulverizer;

conveying discard solids from said first separator and heat transfer apparatus to a second separator and heat transfer apparatus, via a fourth lift, using said second recycle gas;

separating discard solids in said second separator and heat transfer apparatus from said second recycle gas and transferring said second recycle gas to said preheater for use in one of said first, second and third stages of gas contact heating;

conveying discard solids from said second separator and heat transfer apparatus to a third separator and heat transfer apparatus, via a fifth lift, using air;

separating discard solids in said third separator and heat transfer apparatus from said air and transferring said air to said combustion vessel;

conveying discard solids from said third separator and heat transfer apparatus to a fourth separator and heat transfer apparatus, via a sixth lift, using said second recycle gas;

separating discard solids in said fourth separator and heat transfer apparatus from said second recycle gas and transferring said second recycle gas to said preheater for use in one of said first, second and third stages of gas contact heating;

exiting a flue gas from said combustion vessel for use as one of said first, second and third stage of preheating and for establishing a recycle flue gas;

compressing and pumping said recycle flue gas to comprise said second recycle gas for transferring to at least one of said fourth, fifth and sixth lifts wherein said second recycle gas is heated by direct contact with discard hydrocarbon containing solids;

processing said discard solids to recover heat by cooling said discard solids and to generate steam and to heat boiler feedwater for use in said process;

exchanging heat from said retort vapors and using the heat to preheat boiler feedwater and to generate steam for use in said process; and condensing said retort vapors to produce liquid kerogen products.

2. The process of claim 1, further comprising the step of:

pulverizing further the hydrocarbon containing solids using a level of said gas jet deck proximate to said bottom of said retort vessel, said level of said gas jet deck providing pulverizing gas jet streams comprising said first recycle gas.

3. The process of claim 1 further comprising the step of:

recycling particulate hydrocarbon containing solids in an internal retort lift upwardly through said downwardly gravitating hydrocarbon containing solids to a top thereof for further retorting.

4. The process of claim 1, wherein:

said pulverizer driven by said first recycle gas is a mechanical abrader.

5. The process of claim 1, wherein:

said pulverizing driven by said first recycle gas is a series of gas jet abraders.

6. A process for educing hydrocarbons from hydrocarbon containing solids, said process comprising the steps of:

preheating raw hydrocarbon containing solids, in a preheater;

conveying the preheated raw hydrocarbon containing solids to a retort vessel having a top and a bottom and at least two exit ports proximate thereto, wherein the hydrocarbon containing solids are subjected to retorting;

using a second recycle gas to drive retorted hydrocarbon containing solids, exiting said retort vessel at one of said at least two exit ports proximate to said bottom of said retort, through a second lift to said combustion vessel for combusting to discard solids and recycle solids;

conveying recycle solids, via a first lift, using said first recycle gas, from said second lift and an associated separator to said retort;

conveying said discard solids via a plurality of lifts to a plurality of separators, using said first recycle gas and said second recycle gas, to recover heat for at least one of said first, second and third stages of raw shale feed contact heating;

drawing a flue gas from said combustion vessel for use as one of said first, second and third stage of raw shale feed contact heating and for establishing a recycle flue gas;

compressing and pumping said recycle flue gas to comprise said second recycle gas for transferring to at least one of said plurality of lifts wherein said second recycle gas is heated by direct contact with discard solids;

processing said discard solids to recover heat by cooling said discard solids and to generate steam and to heat boiler feedwater for use in said process;

exchanging heat from said retort vapors and using the heat to preheat boiler feedwater and to generate steam for use in said process; and condensing said retort vapors to produce liquid kerogen products.

7. The process of claim 6 wherein said preheater comprises a first stage, a second stage and a third stage of gas contact heating.

8. The process of claim 6 wherein said retorting is a method comprising the steps of:

mixing the raw hydrocarbon containing solids with a stream of high temperature recycle solids using a mixing apparatus proximate to said top in said retort vessel, said recycle solids being transferred to said retort vessel from a combustion vessel via a first lift driven by a first recycle gas;

pulverizing the raw hydrocarbon containing solids with a pulverizer driven by said first recycle gas;

gravitating the hydrocarbon containing solids downwardly toward at least two exit ports proximate to said bottom of said retort vessel;

fluidizing and sweeping the hydrocarbon containing solids in said retort vessel with said first recycle gas introduced into said retort vessel at a gas feed proximate to the bottom of said vessel, said first recycle gas being disbursed throughout the hydrocarbon containing solids by at least one level of a gas jet and gas distribution deck and travelling upwardly countercurrent to said solids and transporting entrained hydrocarbon components; and disengaging the hydrocarbon components from said retort vessel as retort vapors.

* * * * *

UNITED STATES PATENT AND TRADEMARK OFFICE

CERTIFICATE OF CORRECTION

PATENT NO. : 5,156,734

DATED : October 20, 1992

INVENTOR(S) : Vernon O. Bowles

It is certified that error appears in the above-indentified patent and that said Letters Patent is hereby corrected as shown below: Title page, item [57]

In the Abstract, line 20, "all is all" should read --all in all--.

On the Title page, item [54] and col. 1, line 1 and 2,
In the Title, "ENHANCED EFFICIENCY HYDROCARBON EDUCTION PROCESS AND APPARATUS" SHOULD READ --ENHANCED EFFICIENCY HYDROCARBON EDUCTION PROCESS--.

Column 1, line 68, "Process" should read --process--.

Column 2, line 47, "Particles" should read --particles---.

Column 4, line 35, "Processing" should read --processing--.

Column 8, line 42, "circulating 13 compressor 74" should read --circulating compressor 74--.

Column 9, line 42, "Process" should read --process--.

Signed and Sealed this

Seventeenth Day of May, 1994

Bruce Lehman

*Attest:*

BRUCE LEHMAN

*Attesting Officer*

*Commissioner of Patents and Trademarks*